US006715808B2

(12) United States Patent
Oxley et al.

(10) Patent No.: US 6,715,808 B2
(45) Date of Patent: Apr. 6, 2004

(54) POWER STRIKER MECHANISM WITH BACKDRIVE PREVENTION

(75) Inventors: Peter Lance Oxley, Ontario (CA); Gordon Andrew Paton, Ontario (CA)

(73) Assignee: Atoma International Corp., Newmarket (CA)

( * ) Notice: Subject to any disclaimer, the term of this patent is extended or adjusted under 35 U.S.C. 154(b) by 0 days.

(21) Appl. No.: 10/169,663

(22) PCT Filed: Feb. 15, 2001

(86) PCT No.: PCT/CA01/00182

§ 371 (c)(1),
(2), (4) Date: Jul. 8, 2002

(87) PCT Pub. No.: WO01/63075

PCT Pub. Date: Aug. 30, 2001

(65) Prior Publication Data

US 2003/0075934 A1 Apr. 24, 2003

Related U.S. Application Data

(60) Provisional application No. 60/184,042, filed on Feb. 22, 2000.

(51) Int. Cl.[7] ..... E05B 15/02

(52) U.S. Cl. ..... 292/341.16; 292/340; 292/144; 292/DIG. 24; 292/341.15

(58) Field of Search ..... 292/341.15, 340, 292/DIG. 24, 144, 341.16; E05C 1/06

(56) References Cited

U.S. PATENT DOCUMENTS 4,707,007 A * 11/1987 Inoh ..... 292/341.16
4,739,585 A * 4/1988 Pickles ..... 49/280
4,775,178 A * 10/1988 Boyko ..... 292/341.16
4,842,313 A * 6/1989 Boyko et al. ..... 292/341.16
4,869,537 A 9/1989 Compeau et al.
4,982,984 A * 1/1991 Yokota et al. ..... 292/201
5,066,056 A * 11/1991 Schap ..... 292/341.16
5,172,947 A * 12/1992 Schap ..... 292/341.16
5,755,468 A * 5/1998 Buchanan, Jr. ..... 292/341.16
5,938,254 A * 8/1999 Weyerstall ..... 292/341.16

FOREIGN PATENT DOCUMENTS

DE 3721963 * 10/1988

OTHER PUBLICATIONS

Patent Abstracts of Japan vol. 015, No. 212 (M–1118), May 30, 1991 JP 03 059276 A (Honda Motor Co Ltd; Others: 01) Mar. 14, 1991.
International Search Report.

* cited by examiner

*Primary Examiner*—Robert J. Sandy
*Assistant Examiner*—Carlos Lugo
(74) *Attorney, Agent, or Firm*—Clark Hill PLC

(57) ABSTRACT

A power striker mechanism (10) has a housing (22). A striker (18) is mounted on a striker plate (20) that is mounted on the housing for sliding movement between an inboard and an outboard position. A driver plate (44) is mounted to the housing for sliding movement in a direction orthogonal to the movement of the striker plate (20). An actuator (16) effects movement of the driver plate (44) to thereby effect movement of the striker plate (20) between the inboard and outboard positions. The striker plate (20) has a pin (36) and the driver plate has an S-shaped slot (42). The pin slidably engages the S-shaped slot. The S-shaped slot has end regions extending generally parallel to each other and in the orthogonal direction and is interconnected by a diagonally extending section. When the pin (36) is in the end regions of the S-shaped slot, forces imparted on the striker plate (20) are transmitted to the housing (22) and thereby preventing backlash of the actuator (16). When the pin (36) is in the diagonally extending section, movement of the drive plate (44) effects movement of the striker plate (20).

10 Claims, 3 Drawing Sheets

POWER STRIKER MECHANISM WITH BACKDRIVE PREVENTION

This application claims the benefit of provisional 60/184,042 filed on Feb. 22, 2000.

FIELD OF INVENTION

The subject invention relates to a power striker mechanism for use with a closure panel of a motor vehicle.

BACKGROUND OF THE INVENTION

A vehicle closure panel, such as a door, hood or deck, typically includes a seal to prevent exterior environmental elements from intruding into a passenger compartment. The seal also reduces the amount of exterior noise transmitted into the passenger compartment. Seals with higher stiffness coefficients and greater seal pressures are being used to accommodate consumer demand for a quieter passenger compartment. In other words, new seals are becoming much stiffer than those traditionally used. As appreciated, a stiffer seal translates into an increase in force required to completely close the closure panel.

One solution to this problem is the use of a power striker, including the power strikers disclosed in U.S. Pat. Nos. 5,172,947; 4,739,585; 4,982,984; 5,716,085; 5,755,468; 4,842,313; 4,775,178; 4,707,007; 5,765,886; and 5,066,056. During operation of these typical devices, the closure panel is moved to an initial closed position such that the latch engages the striker. The striker is then moved inboard by a power actuator to cinch the closure panel to a final closed position compressing the seals.

One shortcoming of such a mechanism is the vulnerability to damage of the power striker by excessive slamming of the closure panel, typically a door. A slammed door causes damage because the striker is driven inboard of the vehicle and inertial forces of the door are subsequently transmitted through the striker to the power actuator. Repair and replacement of power actuator is complicated by the confined mounting locations required of such mechanisms.

It is thus desirable to develop a powered striker mechanism that is not susceptible to damage by a slamming vehicle closure panel.

SUMMARY OF INVENTION

The disadvantages of the prior art may be overcome by providing a power striker that isolates the actuator from slamming loads imparted to the striker assembly.

According to one aspect of the invention, there is provided a power striker mechanism having a housing. A striker is mounted on a striker plate that is mounted on the housing for slidable movement between an inboard and an outboard position. A driver plate is mounted to the housing for slidable movement is a direction orthogonal to the striker plate. An actuator effects movement of the driver plate to thereby effect movement of the striker plate between the inboard and outboard positions. The striker plate has a pin and the driver plate has an S-shaped slot defining a camming relation. The pin slidably engages the S-shaped slot. The S-shaped slot has end regions extending in the orthogonal direction and is interconnected by a diagonally extending section. When the pin is in the end regions of the S-shaped slot, forces imparted on the striker plate are transmitted to the housing and thereby preventing backlash of the actuator. When the pin is in the diagonally extending section, movement of the driver plate effects movement of the striker plate.

According to another aspect of the invention, there is provided a power striker mechanism. The striker plate and the driver plate are connected together in a camming relation having end phases corresponding to inboard and outboard positions of the striker plate. In the end phases, corresponding to the inboard and outboard positions, the striker plate and the driver plate are coupled to the housing of the mechanism. In an intermediate phase intermediate the end phases, the striker plate and the driver plate are uncoupled from the housing enabling the relative sliding movement of the striker plate and the drive plate.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
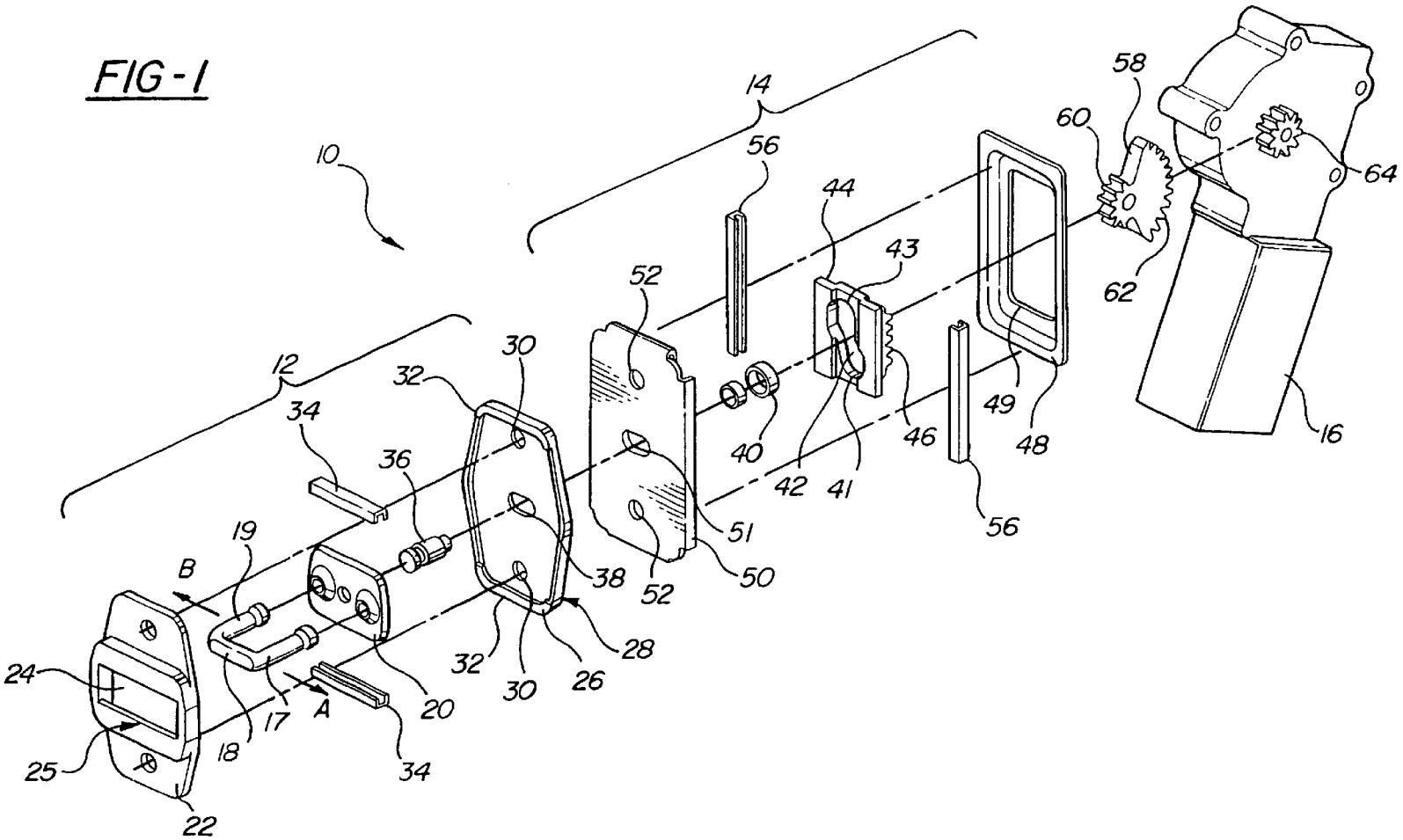
FIG. 1 is an exploded view of a powered striker mechanism of the present invention.
Figure 2:
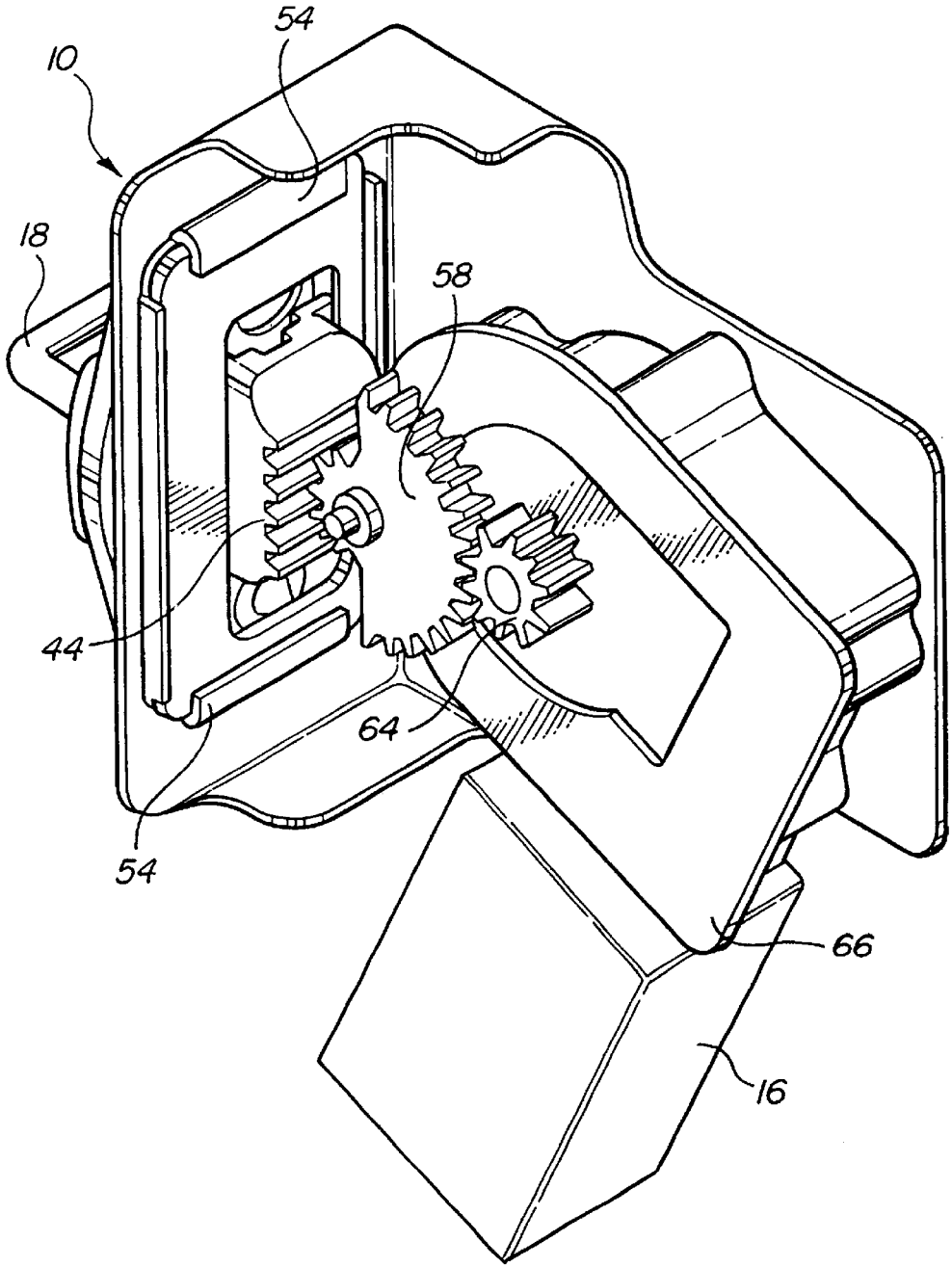
FIG. 2 is a perspective view of the assembled powered striker mechanism of FIG. 1.

Referring to the Figures wherein like numerals indicate like or corresponding parts throughout the several views' a power closure panel striker mechanism is generally shown at 10 in FIGS. 1 and 2. The power striker mechanism 10 comprises a striker assembly 12, a driver assembly 14 and an actuator 16.

Figure 3:
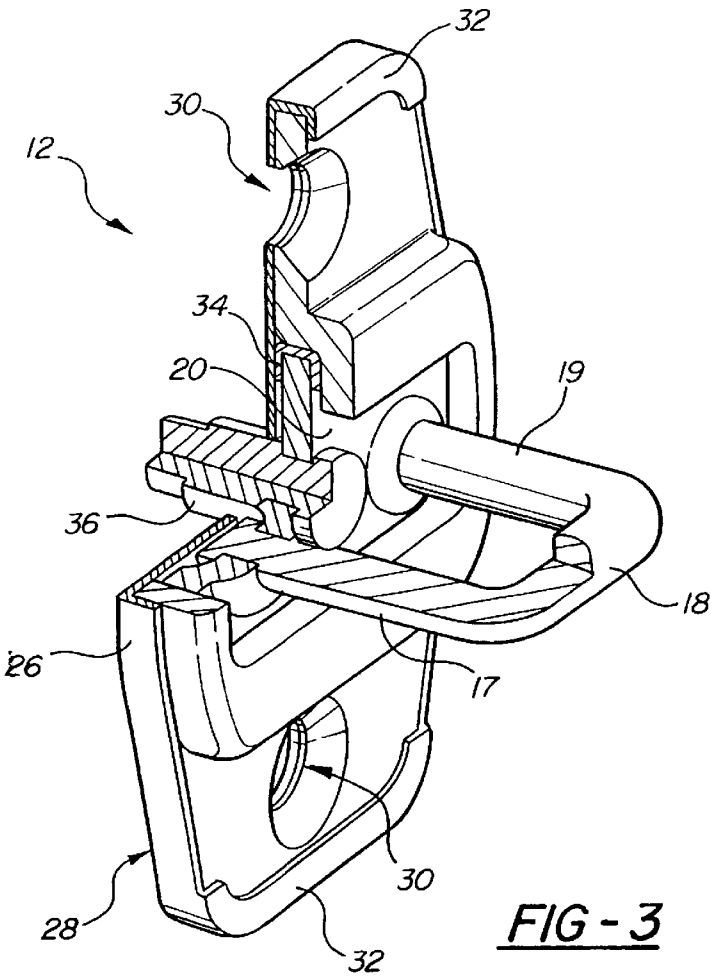
FIG. 3 is a perspective view, partially in section, of the striker assembly of FIG. 1.

Referring to FIGS. 1 and 3, the striker assembly 12 includes a striker plate 20. The striker plate 20 has three aligned holes, with a center hole sized for mounting a driver pin 36. A striker 18, which is U-shaped with outboard 17 and inboard 19 legs, is fixedly attached in the outermost holes of the striker plate 20. The striker plate 20 is slidingly disposed within a cavity 24 of a striker housing cover 22. The striker correspondingly 18 extends through a rectangular opening 25 in the striker housing cover 22.

The striker housing cover 22 fits within a peripheral rim 26 of a backplate 28. The striker housing cover 22 has two countersunk mounting holes 30 through which two mounting screws (not shown) are inserted to secure the striker assembly 12 to the vehicle. The backplate 28 secures the striker housing cover 22 at a top and bottom portion by a lip 32 folded over the striker housing cover 2'. The pin driver 36 extends through a slot 38 in the backplate 28. Further, the backplate 28 cooperates with the striker housing plate 22 to define a first cavity therebetween. Preferably, striker housing cover 22 has a transverse embossment which receives and secures striker bushings 34 above and below the striker plate 20 within the striker housing cover 22 defining a first channel. The striker bushings 34 are held firmly between the striker housing cover 22 and the backplate 28. The striker bushings 34 allow an inboard and outboard sliding movement of the striker plate 20 in the direction of arrows A, B. As appreciated, the driver pin 36 and striker 18 are also limited to horizontal movement along with the striker plate 20.

Figure 4:
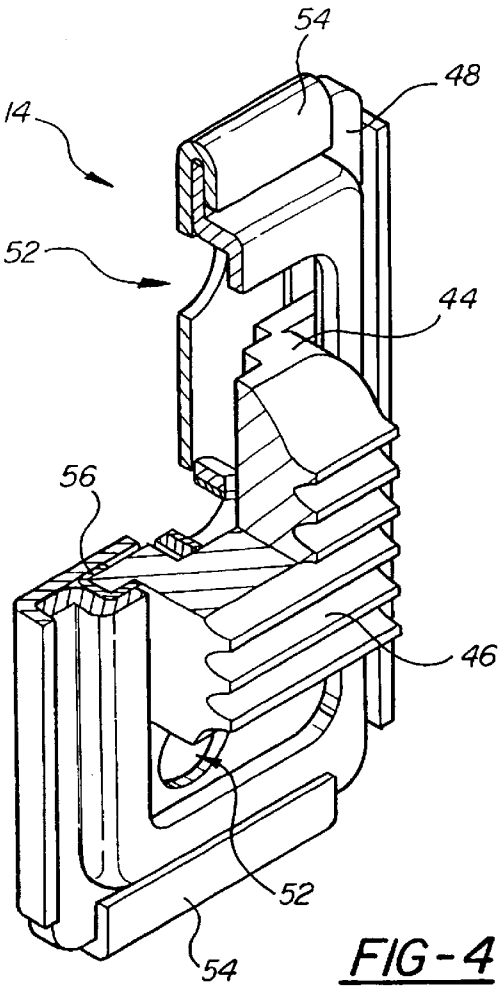
FIG. 4 is a perspective view, partially in section, of a driver assembly for the powered striker mechanism of FIG. 1.

The driver pin 36 fits within a roller 40 disposed within the driver assembly 14, which is also shown in FIG. 4. The roller 40 follows within a cam slot 42 of a driver plate 44 in a camming relation.

The driver plate 44 is rectangular having the cam slot 42 and a set or series of gear teeth 46. The cam slot 42 has an S-shaped profile defined by three phases. The end phases comprise outboard 41 and inboard 43 ends and an intermediate phase comprising a diagonal connection therebetween. Outboard end 41 and inboard end 43 extend parallel to each other and generally orthogonal to the inboard outboard movement of the striker plate 20.

A driver housing plate 48 has rectangular aperture 49 which enables the operative engagement between the actuator 16 and the drive plate 42. Preferably, driver housing plate 48 has a rectangular embossment.

The cover 50 includes upper and lower tabs 54 that are folded over the driver housing plate 48 to secure the driver assembly 14 and define a second cavity therebetween. The cover 50 has an aperture 51 through which the pin 36 extends. A pair of driver bushings 56 are mounted within the second cavity to define a second channel. The driver plate 44 slides within the second channel defined by the driver bushings 56 in a direction perpendicular to the inboard outboard movement of the striker plate 20.

The gear teeth 46 of the driver plate 44 engage a sector gear 58. The sector gear 58 is mounted to the support bracket 66 and has a first set of gear teeth 60 that engages the driver plate 44 and a second set of gear teeth 62 that engages a pinion 64 of the actuator 16.

Referring to FIG. 2, the actuator 16 is mounted to an internal support within the vehicle. A support bracket 66 is a rectangular plate having an opening for the drive gear 64 and is secured to the actuator 16 to provide a mounting location for the sector gear 58. The sector gear 58 is pivotally attached to the support bracket 66. The sector gear 58 transmits rotary motion of the drive gear 64 to the driver plate 44 and acts as a lever arm to multiply torque provided by the motor 16. The position of the striker 18 may be adjusted laterally while maintaining engagement of the driver plate 44 to the sector gear 58 due to extra width provided in the driver gear teeth 46.

The subject power striker mechanism 10 is configured to prevent transmission of impact forces on the striker 18, by a slammed closure panel, back through the driver assembly 14 and to the gear motor 16. An impact force imparted on the striker 18 will be in an inboard outboard direction.

The operation of the power striker mechanism 10 begins once the vehicle closure panel is moved to an initial closed position and the latch on the vehicle closure panel, typically a door, hood or deck, has latched onto the striker 18. The actuator 16 is energized to rotate the drive gear 64 that in turn rotates the sector gear 58. The rotation of the sector gear 58 forces the driver plate 44 to slide. The driver plate 44 engages the roller 40, responsively moves the roller 40 along the outboard end 41 and then diagonally towards the inboard end 43 and then along the inboard end 43. The drive pin 36, which engages the roller, responsively transmits the inboard movement to the striker plate 20 and striker 18, causing the striker 18 to move inboard (Arrow A) and pull the vehicle closure panel to a final closed position.

When the closure panel is opened, the process is reversed to move the striker 18 back to the initial closure panel closed or outboard position (Arrow B).

When a closure panel is slammed shut or other external force applied, such as a collision, a force is exerted on the striker 18 in an inboard direction (Arrow A). As appreciated the force is transmitted from the striker 18 through the striker plate 20 and thereby to the driver pin 36. The driver pin 36 then impacts a side of the cam slot 42 of the driver plate 44. When the driver plate 44 is at either end of travel, pin 36 will be positioned at either the outboard end 41 or the inboard end 43. The outboard end 41 and the inboard end 43 both extend transversely to the direction of movement of the striker plate 20. Thus, when pin 36 is in either of the inboard end 43 or the outboard end 41, the striker plate 20 and the driver plate 44 are coupled to the housing. Intermediate of the inboard end 43 and the outboard end 41, the driver plate 44 and the striker plate are uncoupled from the housing enabling the sliding movement of both and thereby effect the inboard and outboard movement of the striker plate 20. Therefor, forces applied to the striker 18 will not be converted to movement of the driver plate 44. The S-shaped profile of the cam slot 42 prevents impact forces from being transmitted to the actuator 16. Impact loads are ultimately transmitted to the vehicle. The result is the atctuator 16 being insulated from impact forces exerted on the striker 18.

The invention has been described in an illustrative manner, and it is to be understood that the terminology, which has been used, is intended to be in the nature of words of description rather than of limitation. Many modifications and variations of the present invention are possible in light of the above teachings. It is, therefore, to be understood that the invention may be practiced otherwise than as specifically described.

What is claimed is:

1. A power striker mechanism comprising:

a housing, a striker mounted on a striker plate, said striker plate mounted on said housing for sliding movement between an inboard and an outboard position;

a driver plate mounted to the housing for sliding movement in a direction orthogonal to said sliding movement of said striker plate and operably connected therewith in a camming relation, said driver plate having a series of teeth, and an actuator having a drive gear in driving engagement with said series of teeth of said driver plate for effecting movement thereof to thereby effect movement of said striker plate between said inboard and outboard positions, said camming relation comprising end phases corresponding to said inboard and outboard positions wherein said striker plate and said driver plate are coupled to the housing and comprising an intermediate phase intermediate said end phases wherein said striker plate and said driver plate are uncoupled from said housing enabling said sliding movement of said striker plate and said drive plate.

2. A power striker mechanism as claimed in claim 1 wherein one of said striker plate and said driver plate has a pin and the other of said striker plate and said driver plate having an S-shaped slot, said pin in sliding engagement with said S-shaped slot, said S-shaped slot having end regions extending in said orthogonal direction and interconnected by a diagonally extending section, whereby when said pin is in said end regions of said S-shaped slot, forces imparted to the striker are transmitted to the housing and when said pin moves along said diagonally extending section, said driver plate effects movement of said striker plate.

3. A power striker mechanism as claimed in claim 2 wherein said driver plate is in a geared relation with said actuator.

4. A power striker mechanism as claimed in claim 3 wherein said housing has a sector gear mounted thereon, said sector gear operably extending between said series of teeth of said driver plate and said drive gear of said actuator.

5. A power striker mechanism as claimed in claim 4 wherein said housing comprises a backplate engaging a cover plate defining a cavity therebetween, said backplate having an aperture receiving said pin, said cover plate having an aperture through which said striker extends, said cavity having bushings defining a first slide channel, said striker plate slidably received in said slide channel.

6. A power striker mechanism as claimed in claim 5 wherein said housing further comprises a driver housing engaging a driver cover defining a cavity therebetween, said driver cover having an aperture receiving said pin, said driver housing having an aperture providing access for said operative engagement between said drive plate and said actuator, said cavity having bushings defining a second slide channel, said drive plate slidably received in said slide channel.

7. A power striker mechanism as claimed in claim 6 wherein said driver cover and said backplate engage in a back to back relation with said respective apertures aligning enabling said pin to extend therethrough.

8. A power striker mechanism comprising:

a housing having a backplate engaging a cover plate defining a cavity therebetween, said backplate having an aperture, a striker mounted on a striker plate, said striker plate mounted on said housing for sliding movement between an inboard and an outboard position;

a driver plate mounted to the housing for sliding movement in a direction orthogonal to said sliding movement of said striker plate and operably connected therewith in a camming relation, said driver plate having a pin received in said aperture in said backplate, said cover plate having an aperture through which said striker extends, said cavity having bushings defining a first slide channel wherein said striker plate is slidably received in said slide channel, and an actuator operatively engaging said drive plate for effecting movement thereof to thereby effect movement of said striker plate between said inboard and outboard positions, said camming relation comprising end phases corresponding to said inboard and outboard positions wherein said striker plate and said driver plate are coupled to the housing and comprising an intermediate phase intermediate said end phases wherein said striker plate and said driver plate are uncoupled from said housing enabling said sliding movement of said striker plate and said drive plate.

9. A power striker mechanism as claimed in claim 8 wherein said housing further comprises a driver housing engaging a driver cover defining a cavity therebetween, said driver cover having an aperture receiving said pin, said driver housing having an aperture providing access for said operative engagement between said drive plate and said actuator, said cavity having bushings defining a second slide channel, said drive plate slidably received in said slide channel.

10. A power striker mechanism as claimed in claim 9 wherein said driver cover and said backplate engages in a back to back relation with said respective apertures aligning enabling said pin to extend therethrough.

* * * * *

UNITED STATES PATENT AND TRADEMARK OFFICE

CERTIFICATE OF CORRECTION

PATENT NO. : 6,715,808 B2
DATED : April 6, 2004
INVENTOR(S) : Oxley et al.

It is certified that error appears in the above-identified patent and that said Letters Patent is hereby corrected as shown below:

Column 4,
Line 55, “having” should be -- has --.

Column 6,
Line 29, “enages” should be -- engage --.

Signed and Sealed this

Eighth Day of June, 2004

JON W. DUDAS
*Acting Director of the United States Patent and Trademark Office*